US005565294A

United States Patent [19]

Sawai et al.

[11] Patent Number: 5,565,294

[45] Date of Patent: Oct. 15, 1996

[54] ELECTROSTATIC CHARGE IMAGE-DEVELOPING TONER WITH POLYETHYLENE ADDITIVE

[75] Inventors: Tadayuki Sawai, Yamatokoriyama; Tadashi Nakamura, Nara; Toshihiko Murakami, Habikino; Yasuharu Morinishi, Tenri; Katsuaki Sumida, Kitakatsuragi-gun; Toshihisa Ishida, Kashiba, all of Japan

[73] Assignee: Sharp Kabushiki Kaisha, Osaka, Japan

[21] Appl. No.: 561,885

[22] Filed: Nov. 22, 1995

[30] Foreign Application Priority Data

Nov. 29, 1994 [JP] Japan ..... 6-294506

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,379,825 | 4/1983 | Misuhashi et al. | 430/109 |
| 4,481,274 | 11/1984 | Mitsuhashi et al. | 430/109 |
| 4,565,763 | 1/1986 | Uchiyama et al. | 430/109 |
| 5,294,682 | 3/1994 | Fukuda et al. | 430/110 X |
| 5,466,455 | 11/1995 | Taguchi et al. | 430/110 |

FOREIGN PATENT DOCUMENTS

| | | |
|---|---|---|
| 57-0525274A | 11/1982 | Japan . |
| 59-188658A | 10/1984 | Japan . |
| 61-059454A | 3/1986 | Japan . |
| 6-110249A | 4/1994 | Japan . |

*Primary Examiner*—Roland Martin
*Attorney, Agent, or Firm*—David G. Conlin; Milton Oliver

[57] ABSTRACT

The electrostatic charge image-developing toner contains a colorant, a binder resin, and polyethylene having a melt viscosity of 22000 to 26800 mPa·s at 140° C. This electrostatic charge image-developing toner prevents an offset phenomenon on the surface of a fixing roller, and does not adhere to and fuse on a photoreceptor drum to cause no stripy and dotwise stain on a reproduced image, that is, preventing a so-called filming phenomenon. The toner also prevents an offset phenomenon on the photoreceptor drum.

8 Claims, 3 Drawing Sheets

ELECTROSTATIC CHARGE IMAGE-DEVELOPING TONER WITH POLYETHYLENE ADDITIVE

BACKGROUND OF THE INVENTION (1) Field of the Invention

The present invention relates to an electrostatic charge image-developing toner for use in electrophotography, electrostatic recording, electrostatic printing and the like.

(2) Description of the Related Art

Various electrostatic charge image-developing toners for use in electrophotography, electrostatic recording, electrostatic printing and the like have so far been proposed. It is disclosed in, for example, Japanese Patent Publication Sho 57 No.52574 that the use of an electrostatic charge image-developing toner containing a colorant, a styrene resin, and a low molecular weight polyethylene in a conventional electrophotographic process enables good fixing with a heated roller to be carried out efficiently without causing an offset phenomenon on the surface of a fixing roller. Here, the offset phenomenon means that the surface of a fixing roller comes into contact with a toner image by pressing in a heating molten state and a part of the toner image adheres to and transfers to the surface of the fixing roller and that the toner image adhering thereto transfers again to a following sheet to be fixed.

Further, it is described in Japanese Patent Publication Hei 2 No. 6055 that the use of an electrostatic charge image-developing toner which contains 1 to 10 parts by weight of polyalkylene having a weight-average molecular weight of 3000 to 80000 and containing 5 to 60% by weight of a boiling n-hexane-extracted content based on 100 parts by 10 weight of a resin component and which has a dynamic friction coefficient of 0.20 to 0.50 for a conventional electrophotographic process prevents disturbance in a latent image even under a high temperature and high humidity environment without damaging a photoreceptor and prevents the adhesion and fusion of the toner to the photoreceptor, so-called filming, and further causes no stripy or dotwise stain on a reproduced image.

It is described in Japanese Patent Publication Sho 57 No.52574 described above that the electrostatic charge image-developing toner disclosed in the above publication is effective for preventing an offset phenomenon on the surface of a fixing roller. However, a problem is still involved that there is a possibility that a filming phenomenon that a toner or an additive adheres to a photoreceptor drum takes place at a developing step in an electrophotographic process. Considered as a cause by which the filming phenomenon occurs, there are a case where a photoreceptor drum is scratched and a toner adheres thereto, and a case where additives, particularly wax contained in a toner are fused on a photoreceptor drum and the toner adheres thereto.

The electrostatic charge image-developing toner disclosed in Japanese Patent Publication Hei 2 No. 6055 described above is considered to be effective for preventing the filming phenomenon and stripy or dotwise stain on a reproduced image, but it is necessary to measure a dynamic friction coefficient of the toner after the production thereof, which leads to a problem that the process is complicated.

SUMMARY OF THE INVENTION

The present invention has been made in order to solve the conventional problems described above, and an object thereof is to provide an electrostatic charge image-developing toner which prevents an offset phenomenon on the surface of a fixing roller, and does not adhere to and fuse on a photoreceptor drum to cause no stripy and dotwise stain on a reproduced image, that is, preventing a so-called filming phenomenon and also prevents an offset phenomenon on the photoreceptor drum.

According to an aspect of the present invention, there is provided an electrostatic charge image-developing toner which comprises a colorant, a binder resin, and polyethylene having a melt viscosity of 22000 to 26800 mPa·s at 140° C.

The electrostatic charge image-developing toner according to the present invention contains polyethylene which has the melt viscosity falling in a range of 22000 to 26800 mPa·s at 140° C., and therefore an offset phenomenon that a part of a toner image adheres to the surface of a fixing roller and then transfers to a following sheet to be fixed is prevented. Further, since a photoreceptor drum is not scratched by the toner, a filming phenomenon is prevented as well.

Further advantages and features of the invention as well as the scope, nature and utilization of the invention will become apparent to those skilled in the art from the description of the preferred embodiments of the invention set forth below.

DESCRIPTION OF THE PREFERRED EMBODIMENTS

Figure 1:
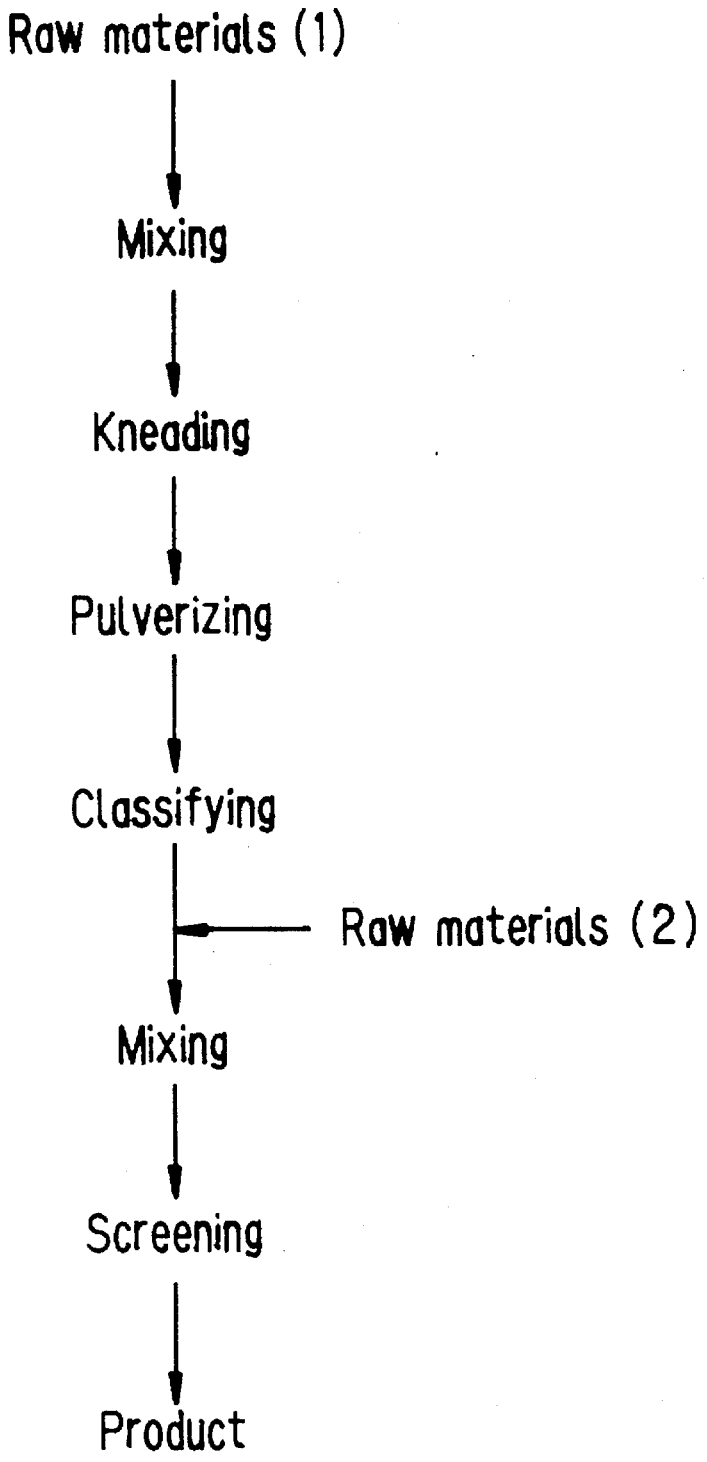
FIG. 1 is a flow chart showing the production steps of the electrostatic charge image-developing toner according to the present invention.

The electrostatic charge image-developing toner according to the present invention contains a colorant, a binder resin, and polyethylene having the melt viscosity of 22000 to 26800 mPa·s at 140° C.

The melt viscosity of polyethylene contained in the electrostatic charge image-developing toner according to the present invention is regulated in a range of 22000 to 26800 mPa·s at 140° C. because of the following reason.

That is, at a developing step in an electrophotographic process, a toner or a component contained in the toner, particularly polyethylene used as wax adheres to or fuses on a photoreceptor drum to cause the filming phenomenon in some cases. Several causes thereof can be considered, and one of them is related to the viscosity of polyethylene. To be concrete, when the melt viscosity of polyethylene is less than 22000 mPa·s at 140° C., respective toner components are not evenly dispersed at a kneading step in the production process of a toner, and some component, for example, a charge controller remains unevenly distributed.

And, the toner which is prepared passing through a pulverizing step in such condition sometimes contains the charge controller in an excess quantity. Such toner is hard as compared with an evenly dispersed toner and is liable to scratch a photoreceptor. As a result thereof, the toner gets into the scratch to cause the filming phenomenon. In addition thereto, since the lower viscosity of polyethylene contained in the toner lowers an apparent viscosity as the toner, the toner or polyethylene fuses on a photoreceptor drum to cause the filming phenomenon.

At a fixing step in the electrophotographic process, a part of a toner image adheres to the surface of a fixing roller, and one revolution of the fixing roller causes the adhering toner to transfer on a following sheet to be fixed. That leads to a so-called offset phenomenon and stain on the sheet to be fixed in some cases. Several causes thereof are considered, and one of them is related to the viscosity of polyethylene contained in the toner. To be concrete, in a case that the melt viscosity of polyethylene is more than 26800 mPa·s at 140° C., the toner melts more than necessity when the toner is heated and fixed at the fixing step in the electrophotographic process since the toner is too soft due to the high apparent viscosity of the toner itself. This results in inferior releasing from the deteriorated fixing roller to cause the offset phenomenon.

Accordingly, the melt viscosity of polyethylene contained in the electrostatic charge image-developing toner according to the present invention is required to fall in a rage of 22000 to 26800 mPa·s at 140° C. In the electrostatic charge image-developing toner according to the present invention, there may be used as a wax component in combination with the polyethylene described above, other resins such as polypropylene, polybutene, polyhexene, an ethylene-propylene copolymer, an ethylene-butene copolymer, mixtures thereof, and the heat-modified resins thereof.

Further, the toner according to the present invention may contain various compounds having a releasing function. These compounds include fatty acid metal salts such as cadmium salt, barium salt, lead salt, iron salt, nickel salt, cobalt salt, copper salt, strontium salt, calcium salt or magnesium salt of stearic acid, zinc salt, manganese salt, iron salt, cobalt salt, copper salt, lead salt or magnesium salt of oleic acid, zinc salt, cobalt salt, copper salt, magnesium salt, aluminum salt or calcium salt of palmitic acid, zinc salt, cobalt salt or calcium salt of linoleic acid, zinc acid or cadmium salt of recinolic acid, lead salt of caproic acid, relatively low molecular weight polypropylene, higher fatty acids having 28 or more carbon atoms, natural or synthesized paraffins, and bis-fatty acid amides such as ethylenebisstearoylamide. These compounds can be contained singly or in combination of two or more kinds.

A styrene-acrylic copolymer is used as the binder resin contained in the toner according to the present invention. Such styrene-acrylic copolymer includes a styrene-methyl acrylate copolymer, a styrene-ethyl acrylate copolymer, a styrene-n-butyl acrylate copolymer, a styrene-isobutyl acrylate copolymer, a styrene-n-octyl acrylate copolymer, a styrene-dodecyl acrylate copolymer, a styrene-2-chloroethyl acrylate copolymer, a styrene-phenyl acrylate copolymer, a styrene-methyl α-chloroacrylate copolymer, a styrene-methyl methacrylate copolymer, a styrene-ethyl methacrylate copolymer, and a styrene-butyl methacrylate copolymer. These copolymers are used singly or in a mixture of two or more kinds.

Further, the mixture of the styrene-acrylic copolymer described above and other resins can be used as the binder resin component for the toner according to the present invention. Other resins which can be mixed with the styrene-acrylic copolymer described above include homopolymers obtained by polymerizing a monomer including vinylnaphthalene, halogenated vinyls such as vinyl chloride, vinyl bromide and vinyl fluoride, vinyl esters such as vinyl acetate, vinyl propionate, vinyl benzoate and vinyl butyrate, α-methylene aliphatic monocarboxylic acid esters such as methyl acrylate, ethyl acrylate, n-butyl acrylate, isobutyl acrylate, n-octyl acrylate, dodecyl acrylate, 2-chloro-ethyl acrylate, phenyl acrylate, methyl α-chloroacrylate, methyl methacrylate, ethyl methacrylate and butyl methacrylate, acrylonitrile, methacrylonitrile, acrylamide, vinyl ethers such as vinyl methyl ether, vinyl isobutyl ether and vinyl ethyl ether, vinyl ketones such as vinyl methyl ketone, vinyl hexyl ketone and methyl isopropenyl ketone, and N-vinyl compounds such as N-vinylpyrrole, N-vinylcarbazole, N-vinylindole, and N-vinylpyrrolidene, or copolymers obtained by copolymerizing these monomers in combination of two or more kinds, or nonvinyl thermoplastic resins such as a rosin-modified phenol formalin resin, an oil-modified epoxy resin, a polyurethane resin, a cellulose resin and a polyether resin.

A colorant which can form a visible image by developing is contained in the toner according to the present invention. Pigments or dyes are used as the colorant and include, for example, carbon black, a nigrosine dye, aniline blue, calcoil blue, chrome yellow, ultramarine blue, Du Pont oil red, quinoline yellow, methylene blue chloride, phthalocyanine blue, malachite green oxalate, lamp black, rose bengal, and the mixtures thereof. Further, the toner according to the present invention may contain a charge controller such as a nigrosine dye, a quaternary ammonium salt, and an azo metal-containing dye.

EXAMPLES

Next, the present invention will be explained in further detail with reference to examples, but the present invention will never be restricted by these examples.

The production process of the toner in the present invention is shown in FIG. 1. The production process will be explained below with reference to FIG. 1.

Example 1

First, the following ones were used as the raw materials (1).

| | |
|---|---|
| Styrene - acrylic copolymer (manufactured by Sanyo Kasei Ind. Co., Ltd.) | 100 parts by weight |
| Carbon black (Regal 330R manufactured by Cabott Co., Ltd.) | 6 parts by weight |
| PolyPropylene (manufactured by Sanyo Kasei Ind. Co., Ltd.) | 2 parts by weight |
| Polyethylene (PE-190 manufactured by Hoechst Japan Co., Ltd.) | 1 part by weight |
| Positive charge controller (Pontron P51 manufactured by Orient Chemical Ind. Co., Ltd.) | 2.5 parts by weight |

After mixing the above raw materials (1) with a super mixer (manufactured by Kawada Mfg. Co., Ltd.) for 2 minutes, they were kneaded with a biaxial extruding machine (PCM-30 manufactured by Ikegai Irons Co., Ltd.). After cooling down, the kneaded composition was pulverized and classified to prepare a toner having an average particle diameter of μm. Polyethylene having a melt viscosity of 22570 mPa·s at 140° C. was used.

The melt viscosity was measured in the following manner.

•Measuring instruments:

B type viscometer (BH model manufactured by Tokimeck Co., Ltd.)

Constant temperature bath (such bath as can maintain the prescribed temperature by a 0.1° C. unit)

Thermometer (having the 0.1° C. scale)

Beaker (inner diameter: 55 mm, height: 110 mm)

•Preparation of a sample

The sample was defined as a standard by measuring it without diluting with a solvent.

•Operation (1) A rotor and the number of revolution each specified by every sample to be measured were used.

(2) A specified beaker was charged with a suitable amount of a sample, a rotor, a guard, and a thermometer and was dipped in a constant temperature bath maintained at a specified temperature.

(3) The sample was stirred quietly, and it was confirmed that the temperature in the beaker reached the specified temperature ±0.2 ° C. The rotor and the guard were connected to a viscometer, and the rotor was immersed between immersion liquid marks in the sample. The position of the rotor was adjusted so that the rotor was located at the center of the beaker. Then, the viscometer was balanced just horizontally, and the temperature was confirmed. It was also confirmed that no bubbles were present.

(4) After detaching a cramp lever and setting the number of revolution as prescribed, the power supply was on. When a pointer was stabilized after rotating several times, the power supply was cut while pressing the cramp lever so that the pointer stopped within a field of vision, and the indication was read to 0.1. The above operation was repeated three times.

•Measuring temperature

Measuring was carried out at 140° C.

Next, the following substances were used as the raw materials (2):

| | |
|---|---|
| Silica (R972 manufactured by Japan Aerosil Co., Ltd.) | 0.15 part by weight |
| Magnetite (KBC100 manufactured by Kanto Denka Co., Ltd.) | 0.3 part by weight |

These were added to and mixed with the toner described above to prepare an electrostatic charge image-developing toner.

Next, using ferrite particles having an average particle diameter of 100 μm as a carrier, the toner described above was mixed in a proportion of 4 parts by weight based on 96 parts by weight of the carrier, which was used as a developer to carry out a copying test according to an electrophotographic process using SHARP SF-8300. The copying tests were carried out under the environment of ordinary temperature and ordinary humidity (20° C., 60%), high temperature and high humidity (35° C., 80%), and low temperature and low humidity (5° C., 20%), respectively.

The measuring methods for an image density (ID) and background fogging (BG) carried out in the respective examples and comparative examples are shown below.

1. Image density (ID):

The image density (ID) was measured with a Macbeth reflection densitometer (manufactured by Macbeth Co., Ltd.).

2. Background fogging (BG):

The background fogging (BG) was measured with a color-difference meter (Z-II manufactured by Nippon Densoku Ind. Co., Ltd.) and a whiteness meter (Z-1001DP manufactured by Nippon Densoku Ind. Co., Ltd.).

The results obtained by carrying out the copying test of the toner obtained in Example 1 are shown in the following Table 1.

TABLE 1

| | Copying time (60000 times) |
|---|---|
| Ordinary temperature & ordinary humidity | No white stripes & no offset |
| High temperature & high humidity | No white stripes & no offset |
| Low temperature & low humidity | No white stripes & no offset |

Figure 2:
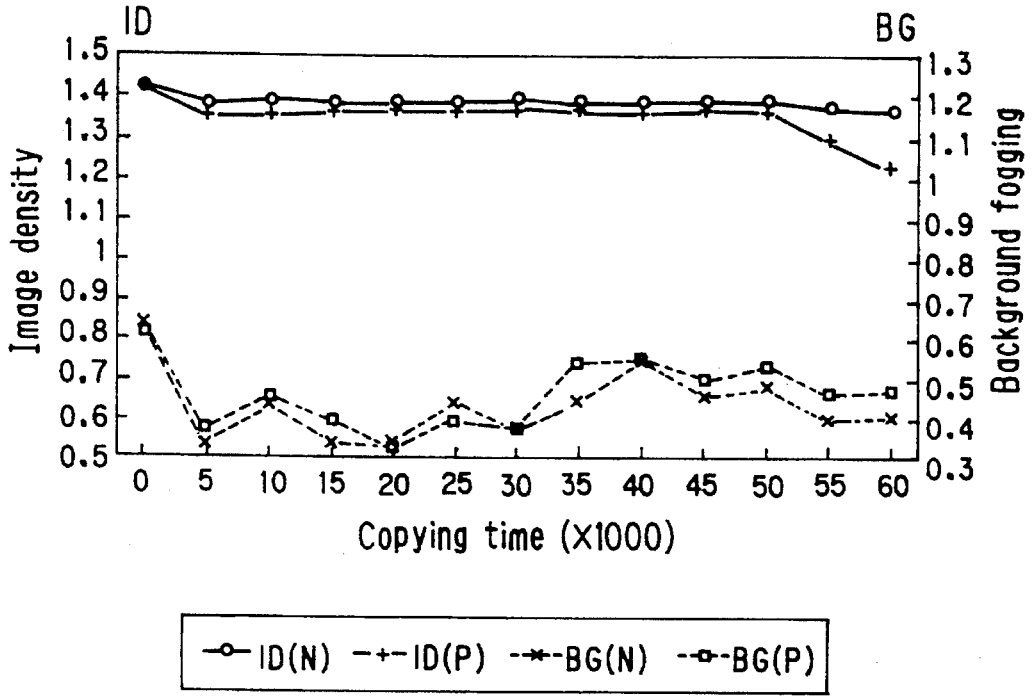
FIG. 2 is a graph showing the results of a copying test for the electrostatic charge image-developing toner according to the present invention at ordinary temperature and humidity.

As apparent from the results shown in Table 1 described above, even after copying 60000 times, a copied image which was as sharp as at the initial stage and which was free of the offset phenomenon and stain (white stripe) was obtained, and no stain on the heat roll and the photoreceptor drum was observed. If the filming phenomenon would take place, white stripes would be generated. The measuring results of the image density (ID) and the background fogging (BG) at ordinary temperature and ordinary humidity are shown in FIG. 2. In the drawing, ID(N) means the image density in a Normal mode, and ID(P) means the image density in a Photo mode. The same applies to BG(N) and BG(P). As apparent from FIG. 2, the results of the both are good and have no problems.

Example 2

An electrostatic charge image-developing toner was prepared in the same manner as that in Example 1, except that polyethylene (PE-190 manufactured by Hoechst Japan Co., Ltd.) having a melt viscosity of 22000 mPa·s at 140° C. was used. The results obtained by carrying out the copying test of the toner obtained in Example 2 are shown in the following Table 2.

TABLE 2

| | Copying time (60000 times) |
|---|---|
| Ordinary temperature & ordinary humidity | No white stripes & no offset |
| High temperature & high humidity | No white stripes & no offset |
| Low temperature & low humidity | No white stripes & no offset |

Figure 3:
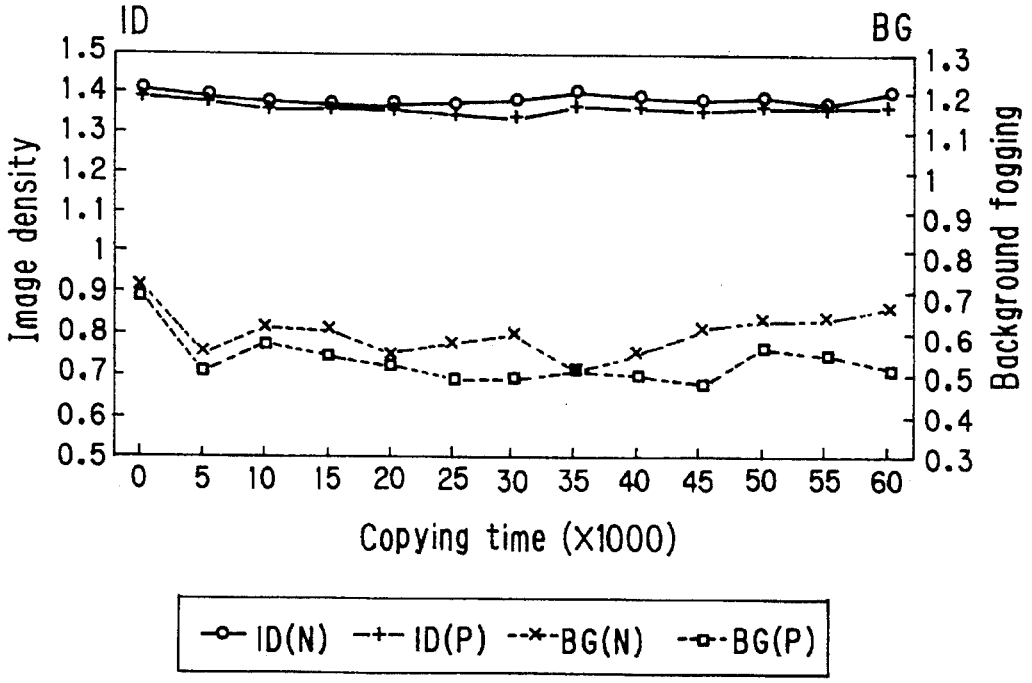
FIG. 3 is a graph showing the results of a copying test for the electrostatic charge image-developing toner according to the present invention at ordinary temperature and humidity.

As apparent from the results shown in Table 2 described above, even after copying 60000 times, a copied image which was as sharp as at the initial stage and which was free of the offset phenomenon and stain (white stripe) was obtained, and no stain on the heat roll and the photoreceptor drum was observed. The measuring results of the image density (ID) and the background fogging (BG) at ordinary temperature and ordinary humidity are shown in FIG. 3. As apparent from FIG. 3, the results of the image densities in both of the Normal mode and the Photo mode are good and have no problems.

Example 3

An electrostatic charge image-developing toner was prepared in the same manner as that in Example 1, except that polyethylene (PE-190 manufactured by Hoechst Japan Co., Ltd.) having a melt viscosity of 26800 mPa·s at 140° C. was used. The results obtained by carrying out the copying test of the toner obtained in Example 3 are shown in the following Table 3.

TABLE 3

| | Copying time (60000 times) |
|---|---|
| Ordinary temperature & ordinary humidity | No white stripes & no offset |
| High temperature & high humidity | No white stripes & no offset |
| Low temperature & low humidity | No white stripes & no offset |

Figure 4:
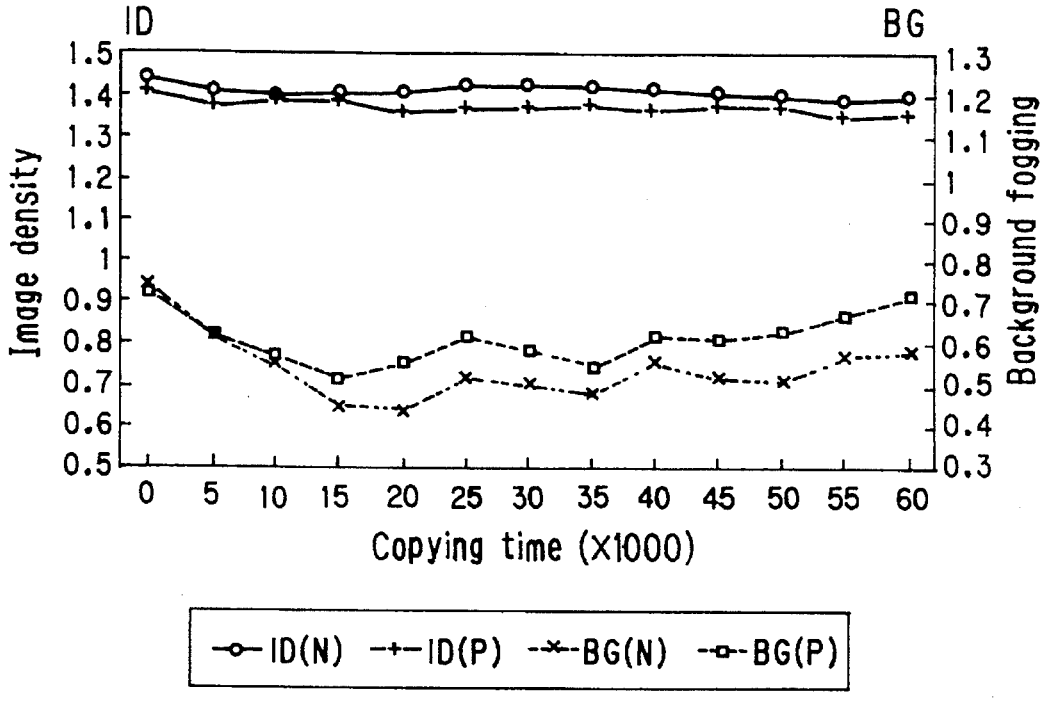
FIG. 4 is a graph showing the results of a copying test for the electrostatic charge image-developing toner according to the present invention at ordinary temperature and humidity.

As apparent from the results shown in Table 3 described above, even after copying 60000 times, a copied image which was as sharp as at the initial stage and which was free of the offset phenomenon and stain (white stripe) was obtained, and no stain on the heat roll and the photoreceptor drum was observed. The measuring results of the image density (ID) and the background fogging (BG) at ordinary temperature and ordinary humidity are shown in FIG. 4. As apparent from FIG. 4, the results of the image densities in both of the Normal mode and the Photo mode are good and have no problems.

Comparative Example 1

An electrostatic charge image-developing toner was prepared in the same manner as that in Example 1, except that polyethylene (PE-190 manufactured by Hoechst Japan Co., Ltd.) having a melt viscosity of 18800 mPa·s at 140° C. was used. The result is obtained by carrying out the copying test of the toner obtained in Comparative Example 1 are shown in the following Table 4.

TABLE 4

| | Copying time | |
|---|---|---|
| | Around 10000 times | 60000 times |
| Ordinary temperature & ordinary humidity | White stripes formed | No offset |
| High temperature & high humidity | White stripes formed | No offset |
| Low temperature & low humidity | White stripes formed | No offset |

Figure 5:
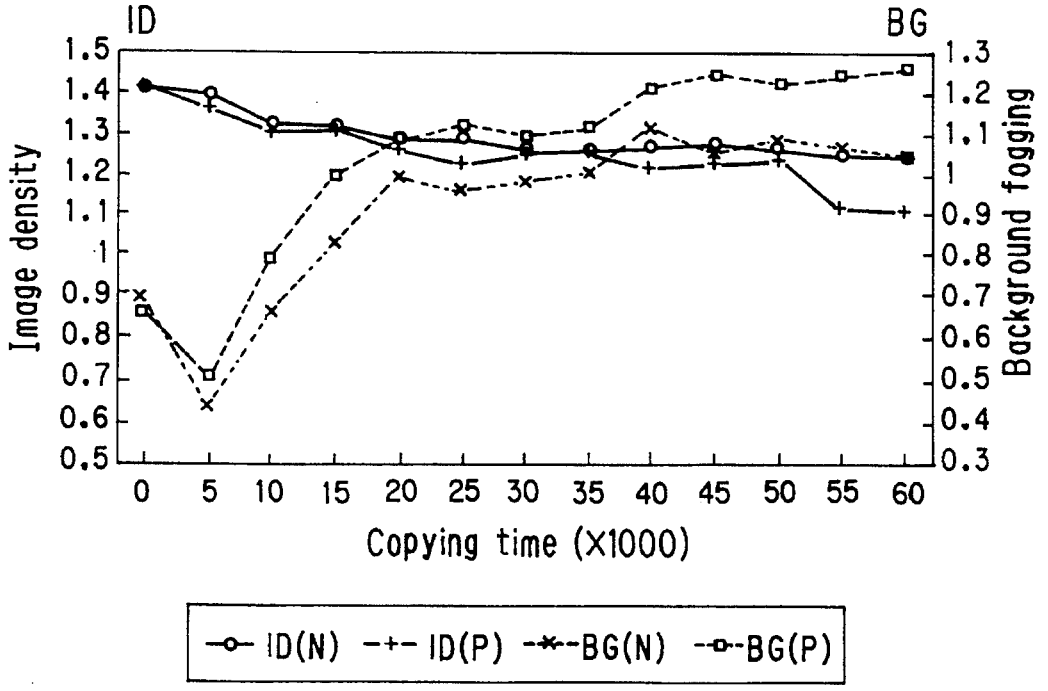
FIG. 5 is a graph showing the results of a copying test for the electrostatic charge image-developing toner falling in an outside of the present invention at ordinary temperature and humidity.

As apparent from the results shown in Table 4 described above, white stripes were observed on the copied images at around 10000 copies in every condition. The measuring results of the image density (ID) and the background fogging (BG) at ordinary temperature and ordinary humidity are shown in FIG. 5. It is apparent from FIG. 5 that both of the image density and the background fogging are deteriorated from around 10000 copies. Further, stain was observed on the photoreceptor drum after the copying test.

Comparative Example 2

An electrostatic charge image-developing toner was prepared in the same manner as that in Example 1, except that polyethylene (PE-190 manufactured by Hoechst Japan Co., Ltd.) having a melt viscosity of 27000 mPa·s at 140° C. was used. The results obtained by carrying out the copying test of the toner obtained in Comparative Example 2 are shown in the following Table 5.

TABLE 5

| | White stripes (After 60000 times) | Offset generated |
|---|---|---|
| Ordinary temperature & ordinary humidity | None | around 5000 times |
| High temperature & high humidity | None | around 3000 times |
| Low temperature & low humidity | None | around 6500 times |

As apparent from the results shown in Table 5 described above, the offset phenomenon was generated at an early stage in all environments.

The use of polyethylene having a melt viscosity of 22000 to 26800 mPa·s at 140° C. as a raw material for an electrostatic charge image-developing toner not only can prevent the filming and offset phenomena and provide a sharp reproduced image free of stripy and dotwise stain but also can prevent stain on a heat roller and a photoreceptor drum. Also, a reproduced image having no problems on an image density and a background fogging can be obtained. Further, since the production method of the toner according to the present invention is basically the same as a conventional production method, an electrostatic charge image-developing toner providing the effects described above can be produced without changing the production line.

What is claimed is:

1. An electrostatic charge image-developing toner comprising a colorant, a binder resin, and polyethylene having a melt viscosity of 22000 to 26800 mPa·s at 140° C.

2. The electrostatic charge image-developing toner according to claim 1, further comprising a wax component selected from the group consisting of polypropylene, polybutene, polyhexene, an ethylene-propylene copolymer, an ethylene-butene copolymer, mixtures thereof and the heat modified resins thereof.

3. The electrostatic charge image-developing toner according to claim 1, further comprising a charge controller selected from the group consisting of a nigrosine dye, a quaternary ammonium salt, an azo metal-containing dye and mixtures thereof.

4. The electrostatic charge image-developing toner according to claim 1, wherein said colorant comprises a pigment or a dye selected from the group consisting of carbon black, a nigrosine dye, aniline blue, calcoil blue, chrome yellow, ultramarine blue, Du Pont oil red, quinoline yellow, methylene blue chloride, phthalocyanine blue, malachite green oxalate, lamp black, rose bengal and mixtures thereof.

5. The electrostatic charge image-developing toner according to claim 1, wherein said binder resin comprises a styrene-acrylic copolymer.

6. The electrostatic charge image-developing toner according to claim 5, wherein said styrene-acrylic copolymer comprises a copolymer selected from the group consisting of a styrene-acrylic acid ester copolymer, a styrene-methacrylic acid ester copolymer and mixtures thereof.

7. The electrostatic charge image-developing toner according to claim 6, wherein said styrene-acrylic acid ester copolymer is selected from the group consisting of a styrene-methyl acrylate copolymer, a styrene-ethyl acrylate copolymer, a styrene-n-butyl acrylate copolymer, a styrene-isobutyl acrylate copolymer, a styrene-n-octyl acrylate copolymer, a styrene-dodecyl acrylate copolymer, a styrene-2-chloro-ethyl acrylate copolymer, a styrene-phenyl acrylate copolymer, a styrene-methyl α-chloroacrylate copolymer and mixtures thereof.

8. The electrostatic charge image-developing toner according to claim 6, wherein said styrene-methacrylic acid ester copolymer is selected from the group consisting of a styrene-methyl methacrylate copolymer, a styrene-ethyl methacrylate copolymer, a styrene-butyl methacrylate copolymer and mixtures thereof.

* * * * *